United States Patent [19]

Brouwer

[11] 3,935,493

[45] Jan. 27, 1976

[54] RADIATION DETECTOR USING DOUBLE AMPLIFCATION

[75] Inventor: Geert Brouwer, Eindhoven, Netherlands

[73] Assignee: U.S. Philips Corporation, New York, N.Y.

[22] Filed: June 20, 1974

[21] Appl. No.: 481,243

[30] Foreign Application Priority Data

June 28, 1973 Netherlands ..... 7309000

[52] U.S. Cl. ..... 313/96; 250/213 R; 313/97; 313/103; 315/12; 340/173 LT

[51] Int. Cl.[2] ..... H01J 39/06

[58] Field of Search ..... 250/213 R, 213 VT; 340/173 CR, 173 LT, 173 LS; 315/10, 11, 12; 313/95, 96, 97, 102, 103

[56] References Cited

UNITED STATES PATENTS

| | | | |
|---|---|---|---|
| 3,027,478 | 3/1962 | Cassman et al. | 313/96 |
| 3,535,574 | 10/1970 | Maeda | 313/377 |
| 3,668,389 | 5/1972 | Kegelman | 313/96 |
| 3,769,539 | 10/1973 | Catchpole | 313/377 |

*Primary Examiner*—Archie R. Borchelt
*Assistant Examiner*—E. R. La Roche
*Attorney, Agent, or Firm*—Frank R. Trifari; Leon Nigohosian

[57] ABSTRACT

In a radiation detector two photocathodes are provided one one either side of a channel amplifier plate. One of these photocathoes is provided, so as to be electrically floating, on a layer of a dielectric on the opposite surface of which an electrode is provided, the lateral conductivity of this photocathode being low either owing to its subdivision into electrically isolated areas or owing to the choice of material.

The potential distribution in the detector can be reversed from a write-in situation to a read-out situation so that the channel plate can be used twice and the amplification is subdivided, enabling it to be increased to a higher level.

6 Claims, 2 Drawing Figures

RADIATION DETECTOR USING DOUBLE AMPLIFCATION

Figure 1:
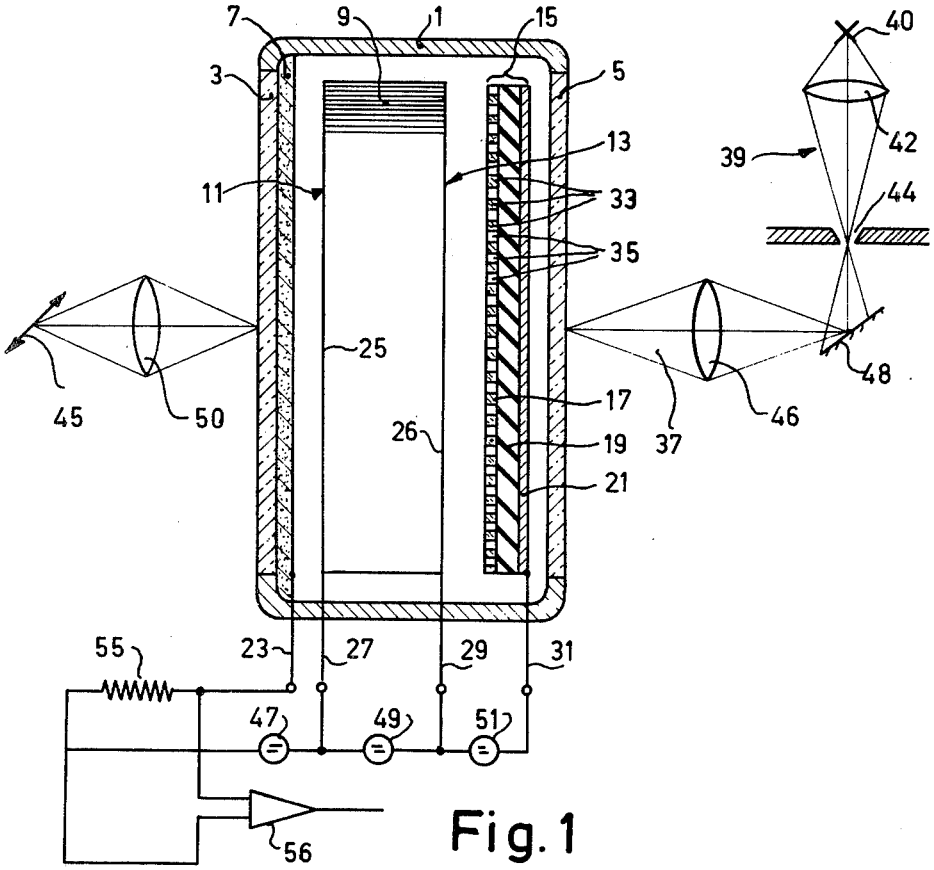

The invention relates to a radiation detector provided with an input photocathode, an electron-optical amplifier device and a target.

Such a radiation detector is described, for example, in U.S. Pat. No. 3,405,309. In the detector described in this patent the photoelectrons establish a charge image on the reverse side of a target, on the surface of which more remote from the photocathode there is provided a material having a high coefficient of secondary emission. The charge image is read out by illuminating a second photocathode according to a raster and by detecting the variation in the electron current which neutralizes the charge image. Thus the radiation image is detected in the form of a video signal.

Disadvantages of the said detector are the comparatively complicated construction, the likelihood of crosstalk from the deflection field of the light spot scanning device to the scanning of the charge image and the restriction of the intrinsic amplification of the detector. To prevent loss of definition of the charge image during the comparatively long integration time, the secondary emissive layer must satisfy exacting requirements.

It is an object of the invention to provide a radiation detector which combines simple construction with a method of reading out in which, without the use of additional equipment, further intrinsic intensification of the image is achieved without using a scanning electron beam in the image space.

For this purpose, according to the invention a radiation detector of the type described is characterized in that the electron-optical amplifying device comprises a channel amplifier plate capable of being successively used in two directions and in that the target comprises a second photocathode which faces the channel amplifier plate and has a comparatively low electric lateral conductivity and a transparent electrically conductive layer separated from the second photocathode by a dielectric intermediate layer.

The bidirectional use according to the invention of a known channel amplifier plate as an electron-optical amplifying device not only results in a simpler construction but also provides division of the amplification into write amplification and read amplification.

This may simply be effected by reversing the polarities of the potentials applied to the channel amplifier plate. Since in this manner image intensification is obtained during read-out also, only comparatively small potential differences are required in the potential field to be produced by the incident image. In a preferred embodiment of a detector according to the invention the second photocathode forms a line pattern the direction of which is adapted to the incoming image which, for example, is a line spectrum to be analysed. In this case a ribbon-shaped light beam adapted to the said line pattern may be used to illuminate the second photocathode.

Figure 2:
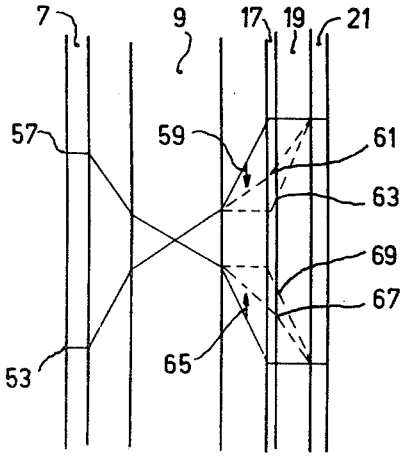

Embodiments of the invention will now be described, by way of example, with reference to the accompanying diagrammatic drawings, in which:

FIG. 1 is a cross-sectional view, partly schematic, of a radiation detector having a line-shaped second photocathode for analysing a line spectrum, and FIG. 2 shows potential distributions produced in this detector during writing and reading.

Referring now to FIG. 1, the preferred embodiment shown of a radiation detector comprises, within an envelope 1 having an entrance face plate 3 and an exit face plate 5, an input photocathode 7, a channel amplifier plate 9 having end faces 11 and 13 and a target 15 which includes a second photocathode 17, a dielectric intermediate layer 19 and a transparent electric conductor 21. The input photocathode 7 has an electric lead-in 23 and in the embodiment shown is provided on the inner surface of the entrance face plate 3. The material of the input photocathode 7 may be adapted to the nature of the radiation to be detected and may for example be caesium iodide. To ensure a fixed layer potential the material must have sufficient electric conductivity or the layer must be supplemented by an additional electrically conductive layer, which in this case must obviously be connected to the lead-in 23. The input photocathode may alternatively be provided on the end face 11 of the channel amplifier plate, in which case it may also act as an electrode, provided that the electric conductivity is high enough.

The channel amplifier plate 9 is provided at its end faces 11 and 13 with electrodes 25 and 26 respectively having lead-ins 27 and 29 respectively. The channel amplifier plate is of a known type but with respect to its electron-optical properties must be capable of being used in both directions. If desired, a channel amplifier plate having non-straight channels may be used.

In order to prevent disturbances of electrical nature the target 15 is preferably mounted between the channel amplifier plate and the exit face plate so as to be clear of these two members, however, it may alternatively be provided on the inner surface of the exit face plate 5. Because to ensure satisfactory resolution the second photocathode 17 must have poor electric lateral conductivity and must be electrically floating, it cannot simply be disposed in contact with the end face 13 of the channel amplifier plate. The transparent electrode 21 of the target has an electric lead-in 31. In the embodiment shown the second photocathode 17 is provided on the intermediate layer in the form of a line pattern of strips 33 which are electrically insulated from one another by openings 35 which extend at right angles to the plane of the drawing. With such a structure the material of the photocathode need not be electrically insulating itself and may be the same as the material of the input photocathode. In another preferred embodiment the second photocathode consists of a homogeneous layer of electrically poorly conductive material, for example a known trialkali photocathode material. In the latter case the potential image may be two-dimensional and be read out by means of a light spot. The dielectric intermediate layer 19 provides capacitive coupling between the strips and the transparent conductor 21 and may be a layer of mica. The transparent electrode 21 preferably is a homogeneous layer of tin oxide or another electrically conductive material transparent to read-out light 37, however, it may alternatively be a mesh electrode.

The read-out light 37 is produced, for example, by a source of light 39 an incandescent element 40 of which, for example a filament or a gas discharge, is imaged by a lens 42 on a slit diaphragm 44 the direction of length of which extends parallel to the strips 33. A second lens 46 forms an image of the diaphragm 44 on the plane of the second photocathode 17. A rotating mirror 48 enables the image to be displaced over this plane. The width of the slit diaphragm 44 is for example such that the image on the second photocathode 17 is not wider than the width of the strips of the photocathode.

If in a device as described an image 45, in particular a line spectrum, is projected onto the first photocathode either directly or by means of an optical system 50, electrons are emitted from this photocathode which in the case of a positive potential (of for example 100 volts) of the electrode 25 relative to the first photocathode are accelerated towards the channel plate, local illumination corresponding to a local variation of the number of photoelectrons. The photo currents are amplified in the channel plate in the case of a positive voltage (of for example about 1 kV) of the electrode 26 relative to the electrode 25. The amplified photocurrent emerges from the end face 13 of the channel plate and impinges on the second photocathode. On this photocathode 15 a charge image which corresponds to the radiation image incident on the first photocathode is produced. The mean potential of the second photocathode must be higher (for example by 100 volts) than that of the electrode 26, which may be obtained by the potential of the transparent electrode 21. The potential variation during the write period, which variation can be adjusted by means of voltage sources 47, 49 and 51, is indicated schematically by a line 53 in FIG. 2. During writing, the potential distribution between the second photocathode 17 and the dielectric intermediate layer 19 varies so that the field strength across the layer 19 increases from zero in the unilluminated condition to a maximum permissible value on saturation of the photocathode 17. As a result, the part of the potential line of FIG. 2 which is situated within the target 15 is displaced in the direction indicated by an arrow 59 via an intermediate situation indicated by a dot-dash line 61 to a final situation indicated by a dash line 63. In the final situation the entire potential difference is bridged by the layer 19, which defines the said maximum value to prevent breakdown. With normal use the said final situation will not be reached, or at most will be reached in a few points or lines, because illumination is previously stopped. A meter may be connected in the lead 31 to indicate the occurrence of saturation.

During read-out the voltage sources 47, 49 and 51 are reversed in polarity, the strips 33 being scanned with a linear beam of light so as to be read strip by strip. In this process the potential difference between each successive strip of the second photocathode 17 and the electrode 26 is reduced substantially to zero whilst simultaneously the positive charge on the floating second photocathode 17 required for a new recording is built up. The electrons emitted from the second photocathode impinge on the channel plate, in which they are again multiplied by secondary emission. The resulting electron current emerges from the end face 11 of the channel plate and is captured by the first photocathode which is electrically conductive. Because in the first photocathode local image formation is no longer desired, the electrons from a given location of the second photocathode preferably enter the channel plate over a maximum area. This may be promoted by applying stray fields, for example alternating magnetic or electric fields, between the end face 13 of the channel plate and the second photocathode. The electric signal produced in the first photocathode is derived via the lead-in 23 and can be detected across a resistor 55 via an amplifier 56 and may, for example, be applied to a recorder. The potential variation in the detector during read-out is schematically shown in FIG. 2 by a line 57.

The potential difference between the final electrode 26 of the channel amplifier plate and the second photocathode 17 is reduced to zero during read-out, the part of the potential line 57 situated within the target 15 being changed in the direction indicated by an arrow 65 via a situation represented by a dot-dash line 67 to a dash line 69. If in this situation photoelectrons are still being emitted from the second photocathode, they are not accelerated towards the channel plate and hence are not captured. It should be mentioned that the absolute potential is not of importance and that the relative levels of the two potential lines shown in the drawing are arbitrary, with a point of intersection at the middle of the channel plate for reasons of symmetry. In practical embodiments the potential of the layer 7 or that of the electrode 21 will preferably remain constant in polarity reversal. From the above it will be clear that the spacing between the end face 13 of the channel plate and the second photocathode preferably is as small as possible. It may be of advantage to provide an auxiliary electrode, preferably in the form of a mesh electrode, between the end face 13 and the second photocathode. Such an electrode enables the field strength at both faces to be controlled irrespective of the existing potential difference and further permits a dispersing electric field to be introduced during read-out.

Instead of the abovedescribed read-out according to a line, which is the most suitable method when analysing a line spectrum, a scanning light spot may be used. This produces a non-repeated signal in the form of a television image signal. If a flying spot scanner is used as a light source, the required deflection fields will provide no interference, because no scanning electron beam is used in the image space.

Depending upon the method of reading out and the form of the image information to be analysed the second photocathode may be provided on the dielectric layer in another form. For example, the strips for analysing a line spectrum divided into orders may be subdivided in the direction of length, read-out being performed by means of a ribbon-shaped light beam the length of which matches that of the strip sections. Also, the second photocathode may be provided in the form of a homogeneous layer, the low lateral conductivity being obtained by the nature of the material or, as the case may be, by the method of deposition also. If instead of image lines image points are to be analysed, the second photocathode may be provided as a mosaic. This may, for example, be realised by deposition from vapour via a mesh structure or, as described in Netherlands patent application No. 7,109,571 (PHN. 5730) by scoring or crazing an initially homogeneous layer of material.

The spectral sensitivity of the second photocathode can be matched to the read-out light, or conversely the wavelength of this light may be matched to the photocathode material used (for example 4,000 A.U.). Similarly, the spectral sensitivity of the first cathode may be matched to the wavelengths (for example 2,400 to 3,500 A.U.) which occur in the image information to be analysed.

What is claimed is:

1. A radiation detector comprising:

a. an input photocathode;

b. an electron-optic amplifying member facing said input photocathode and comprising a channel amplifier plate structure capable of being used in two directions; and c. a target structure comprising a second photocathode of relatively low lateral electric conductivity that faces said amplifier plate, a transparent electrically conductive layer, and a dielectric layer disposed between said second photocathode and said transparent layer.

2. A radiation detector as recited in claim 1, wherein said second photocathode comprises discrete parts that are electrically isolated from each other.

3. A radiation detector as in claim 1, wherein said second photocathode comprises substantially homogeneous layer consisting of a material having low lateral electric conductivity.

4. A radiation detector as in claim 1, wherein said second photocathode comprises a substantially homogeneous layer comprising electrically insulating junctions.

5. A radiation detector as in claim 1, wherein said second photocathode comprises a line pattern and said detector further comprises means for generating a ribbon-shaped light beam and means for moving said light beam across said target in a direction at right angles to said target, whereby said detector can be used as a line spectrum analyzer.

6. A radiation detector as in claim 5, wherein said line pattern is subdivided in its length direction into paths of uniform width and said light beam generating means comprises means for sequentially scanning said paths.

* * * * *